US005219114A

United States Patent [19]

Kajiwara et al.

[11] Patent Number: 5,219,114

[45] Date of Patent: Jun. 15, 1993

[54] CONTINUOUS HOT STRIP ROLLING SYSTEM AND METHOD THEREOF

[75] Inventors: Toshiyuki Kajiwara, Hitachi; Tadashi Nisino, Hitachi; Keiji Miyakozawa, Katsuta; Masaaki Kouga, Hitachi, all of Japan

[73] Assignee: Hitachi, Ltd., Tokyo, Japan

[21] Appl. No.: 789,827

[22] Filed: Nov. 8, 1991

[30] Foreign Application Priority Data

Nov. 8, 1990 [JP] Japan ..... 2-203140

[51] Int. Cl.[5] ..... B21B 1/00

[52] U.S. Cl. ..... 228/158; 228/5.7; 72/234; 29/81.08

[58] Field of Search ..... 228/5.7 X, 15.8, 176, 228/5.1; 72/234 X, 225, 227; 134/5, 122 R; 29/81.08 X

[56] References Cited

U.S. PATENT DOCUMENTS

| | | | |
|---|---|---|---|
| 1,804,111 | 5/1931 | Paterson | 72/227 |
| 1,810,167 | 6/1981 | George | 72/234 |
| 3,511,250 | 5/1970 | Gallucci et al. | 29/81.08 X |
| 4,018,376 | 4/1977 | Capetti | 228/158 |
| 4,106,318 | 8/1978 | Yanagimoto et al. | 72/366.2 X |
| 4,294,394 | 10/1981 | Iida et al. | 228/158 |
| 4,384,468 | 5/1983 | Ginzburg et al. | 72/234 |
| 4,430,876 | 2/1984 | Ginzburg | 72/234 |
| 4,444,038 | 4/1984 | Ginzburg | 72/234 |
| 4,502,311 | 3/1985 | Eibe | 72/206 |
| 4,706,871 | 11/1987 | Kajiwara et al. | 228/158 |

FOREIGN PATENT DOCUMENTS

| | | | |
|---|---|---|---|
| 0460655 | 12/1991 | European Pat. Off. . | |
| 714111 | 11/1941 | Fed. Rep. of Germany . | |
| 1652541 | 12/1971 | Fed. Rep. of Germany . | |
| 50-95160 | 7/1975 | Japan . | |
| 50-109866 | 8/1975 | Japan . | |
| 58-112601 | 7/1983 | Japan . | |
| 101204 | 6/1984 | Japan . | |
| 184481 | 9/1985 | Japan | 228/158 |
| 213382 | 10/1985 | Japan | 228/158 |
| 231504 | 11/1985 | Japan . | |
| 61-17305 | 1/1986 | Japan . | |
| 17305 | 1/1986 | Japan . | |
| 056708 | 3/1986 | Japan . | |
| 61-56708 | 3/1986 | Japan . | |
| 68213 | 3/1988 | Japan . | |
| 235502 | 9/1990 | Japan . | |

OTHER PUBLICATIONS

Five-page Search Report.

*Primary Examiner*—Kenneth J. Ramsey
*Attorney, Agent, or Firm*—Evenson, McKeown, Edwards & Lenahan

[57] ABSTRACT

In a continuous hot strip rolling system in which bars are joined between a roughing train and a finishing train for continuous rolling, the roughing train includes two two-high twin-roll arranged stands each having two pairs of work rolls. The four two-high mills provided by the two twin-roll arranged stands including four pairs of work rolls are disposed close to each other so as to provide a tandem rolling in which a material to be rolled is rolled simultaneously by the two adjacent mills. A slab having a thickness of 200 to 240 mm is rolled by the two twin-roll arranged stands to obtain a bar of about 80 mm. A width press is provided near the entrance of the No. 1 stand. A descaling device is provided at the entrance of each of the two stands. The descaling device has a nozzle which is movable in the direction transverse to the direction of travel of the material to be rolled. A non-driven roll edger is provided at the exit of each of the two stands. Thus, generation of camber in the roughing rolling process can be reduced, and stable joining continuous rolling can be conducted. Furthermore, the overall length of the system can be reduced, and reduction in the bar temperature, which occurs until the bar reaches the joining position, can be lessened. Rational bar joining can be conducted.

12 Claims, 4 Drawing Sheets

CONTINUOUS HOT STRIP ROLLING SYSTEM AND METHOD THEREOF

BACKGROUND OF THE INVENTION

1. Field of the Invention

The present invention relates to a continuous hot strip rolling system and a method thereof More particularly, the present invention pertains to a continuous hot strip rolling system in which bars are joined to each other between a roughing train and a finishing train for continuous rolling, and a method thereof.

Regarding the hot strip rolling system, there has been a strong demand for sequentially joining the materials to be rolled to conduct continuous rolling in the finishing train, and various proposals have been made to meet this demand. However, none of these proposals has been put into practical use. Joining of the materials to be rolled for continuous rolling (hereinafter referred to as a "joining continuous rolling") has been desired because it can improve feeding of thin strips, because it enables a shape control function utilizing tension rolling to be provided, because it enables a high reduction rolling to be conducted in a subsequent stand due to supply of a lubricant, and because it enables strip curving camber to be reduced. Generation of camber causes troubles not only in the finish rolling process but also in the subsequent processes, such as a pickling process or cold rolling process When strips have camber, the leading and trailing ends of that strip must be cut off, thus greatly reducing yield In most of the conventional joining continuous rolling techniques, the bars are joined to each other between the roughing and finishing trains, as in the case of, for example, U.S. Pat. No. 4,706,871. In U.S. Pat. No. 4,706,871, all the mill stands, including those in the roughing train, are shown in FIGS. 1 and 2 as if they were two-high mill stands, for the purpose of simplifying illustration thereof. However, it has actually not been practiced that all the mill stands in the roughing train be constituted of the two-high mill stands alone. In the case of unidirectional rolling, four-high mill stands are generally employed. These four-high mill stands are disposed separately at a distance from each other, which distance increases as the material being rolled becomes longer due to rolling so that the same material being rolled is not caught by two adjacent mill stands at the same time, as in the case of U.S. Pat. No. 4,706,871. This arrangement of the four-high mill stands is advantageous, because it allows individual mill stand to be driven independently and thus allows inexpensive motors, such as a synchronous motor which does not require speed control, to be used. In the rolling technique disclosed in JP, A, 58-112601, a single reversable roughing mill stand for conducting the unidirectional rolling is provided in place of the roughing train.

In U.S. Pat. No. 4,444,038 which is not concerned with the joining continuous rolling technique, all the mill stands are shown as being the two-high mill stands for the purpose of simplifying illustration, as in the case involving the aforementioned U.S. Pat. No. 4,706,871 Meanwhile, the use of two-high mill has been proposed in the conventional techniques disclosed in, for example, JP, A, 2-235502, JP, A, 61-17305, JP, A, 61-56708, JP, A, 50-95160, and JP, A, 50-109866. In JP, A, 2-235502, it has been proposed to alternately use three pairs of rolls in order to prevent overheating of the mill and to incorporate two pairs of upstream rolls in a common housing. JP, A, 61-17305 and JP, A, 61-56708 have disclosed the use of a common housing for a two-high mill and a four-high mill to achieve high reduction rolling. JP, A, 50-109866 has proposed the incorporation of both a planetary mill and two sets of two-high mills in a common housing.

In the conventional joining continuous rolling techniques, roughly rolled bars having a thickness from 30 to 40 mm are joined to each other. In order to reduce a temperature difference between leading and trailing ends of the bars to be joined, it has been proposed in JP, A, 58-112601 to coil each bar at the exit of the roughing train and then to uncoil it for joining.

In the hot rolling process, when the material being rolled has a scaled surface, the scale bites into the surface of a product, leaving a flaw and thus greatly deteriorating the quality of the product. Hence, a descaling device for ejecting water under pressure is provided on the rolling line for peeling off or removing the scale on the surface of the material to be rolled. Although the water ejecting nozzle of such a descaling device is generally of the fixed type, JP, A, 63-68213 discloses a descaling device having a pivotal nozzle to improve the scale removal performance.

In the aforementioned JP, A, 50-95160 which discloses a rolling system in which a planetary mill and two sets of two-high mills are disposed close to each other, a gas device is provided to cover the portions of the material being rolled between the planetary mill and the two-high mill located adjacent to the planetray mill and between the two two-high mills, with an inactive or reducing gas in order to prevent generation of scale.

However, the conventional joining continuous rolling systems have the following drawbacks.

In the roughing train, when the bar is roughly rolled to a thickness of about 30 to 40 mm by the four-high mill stands, generation of camber cannot be avoided. Such a bar is cut by a shear. In that case, the lateral center of the trailing end of the preceding material to be rolled does not coincide with the lateral center of the leading end of the subsequent material, and the gap between the ends of the two materials is not uniform in the lateral direction. This makes the joining operation difficult. Camber is generated in the roughing roll for the following reasons. A difference between upper and lower torques is generated in the four-high mill stand when the bar is bitten in the four-high mill and a rolling torque is thereby generated. Consequently, the work rolls in the four-high mill stands are subjected to upper and lower opposite horizontal forces, and are thereby moved in a horizontal direction due to backlash between bearing boxes of the work rolls and a housing thereof, thus making the draft non-uniform in the lateral direction. As the thickness of the bar is reduced, the non-uniformity of the rolling reduction in the lateral direction is increased, thus increasing camber.

In the roughing train, when the mill stands are disposed separately at a long distance from each other, the length of the overall system is increased, and the material being rolled is thereby cooled excessively, which increases reduction in the temperature of the bars which occurs until the bars reach the joining position. Hence, the time required for heating and joining the bars is increased, and effective joining which utilizes the temperature of the bars is precluded. Also, as the length of the rolling system is increased, the installation cost is increased.

Furthermore, since the bar is rolled to a thickness of 30 to 40 mm in the roughing rolling, when the joining time is long, the joining device must travel a long distance to join the bars without using a looper. Assuming that the conventional joining time is about one minute, if the rolling rate at the exit of the finishing train is 600 m/min to obtain a 2 mm thick product while the rolling rate at the entrance of the finishing train is 30 m/min for bars having a thickness of 40 mm, the joining machine must travel 30 m. When a looper is used, a 30 m long looper is required, which is quite unpractical. Also, When the looper is used, since the bar makes contact with the rollers at the entrance of the looper and stops, it is locally cooled, deteriorating the quality thereof. Furthermore, since the bar having a thickness of 30 to 40 mm cools quickly, the temperature difference between the leading and trailing ends of the bar is large. This causes the temperatures to greatly differ from each other in portions between which the joined section is located, thus changing the finish temperature and deteriorating the quality of the product. Hence, it has been proposed in JP, A, 58-112601 to coil the bar at the exit of the roughing train and then to unroll the bar and join, as stated above. However, this system is complicated, and generation of flaws on the surface of the bar due to coiling and uncoiling must be prevented.

SUMMARY OF THE INVENTION

An object of the present invention is to provide a continuous hot strip rolling system capable of stable joining continuous rolling by reducing generation of camber in the rough rolling process, and a method thereof.

Another object of the present invention is to provide a continuous hot strip rolling system capable of shortening the length of the overall system.

A further object of the present invention is to provide a continuous hot strip rolling system capable of rational bar joining by reducing reduction in the temperature of the bar which occurs until the bar reaches a joining position, and a method thereof.

To achieve the aforementioned objects, according to the first aspect of the present invention, there is provided a continuous hot strip rolling system in which bars are joined between a roughing train and a finishing train for continuous rolling, wherein all the mill stands in the roughing train are of two-high mill stands disposed close to each other so as to provide tandem rolling.

In the continuous hot strip rolling system, the roughing train preferably includes as the two-high mill stands at least one twin-roll arranged stand having two pairs of work rolls which are incorporated in a common housing assembly having a window portion at each of two sides thereof, bearing boxes for each of the work rolls being incorporated in the window portion provided at each side of the housing.

More preferably, the roughing train includes the two twin-roll arranged stands which are disposed in series.

The housing assembly of each twin-roll arranged stand may have an intermediate post between the two pairs of work rolls in each of the window portions.

The continuous hot strip rolling system preferably further comprises water-ejecting descaling means disposed at an entrance of the twin-roll arranged stand, and means for covering a material to be rolled with an inactive or reducing gas between the two pairs of work rolls in the twin-roll arranged stand.

The descaling means preferably has a nozzle which is movable in a direction transverse to the direction of travel of the material to be rolled at a variable angle.

The continuous hot strip rolling system preferably further comprises slab width adjusting means disposed at an entrance of the roughing train for adjusting a width of a slab being conveyed to the roughing train. The slab width adjusting means is preferably of a press type.

The continuous hot strip rolling system preferably further comprises at least one non-driven type roll edger disposed in relation to the two-high mill stand. Practically, the continuous hot strip rolling system may include roll edgers each of which is disposed at an exit of each of the two twin-roll arranged stands, at least the upstream roller edger being of the non-driven type.

According to the second aspect of the present invention, there is provided a rolling method in a continuous hot strip rolling system in which bars are joined between a roughing train and a finishing train for continuous rolling, which comprises the steps of disposing a plurality of two-high mill stands alone as mill stands in the roughing train close to each other so as to provide tandem rolling, rolling a slab by the roughing train to produce a bar having a thickness of 60 mm or above, and joining the bars having the aforementioned thickness to each other.

According to the third aspect of the present invention, there is provided a rolling method in a continuous hot strip rolling system in which bars are joined between a roughing train and a finishing train for continuous rolling, which comprises the steps of disposing a plurality of two-high mill stands alone as mill stands of the roughing train close to each other so as to provide tandem rolling, and making rolling by the roughing train unidirectional rolling.

According to the fourth aspect of the present invention, there is provided a rolling method in a continuous hot strip rolling system in which bars are joined between a roughing train and a finishing train for continuous rolling, which comprises the steps of disposing a plurality of two-high mill stands alone as mill stands of the roughing train so as to provide tandem rolling, disposing descaling means having a water ejecting nozzle movable in a direction transverse to the direction of travel of a material to be rolled at an entrance of the roughing train, and conducting descaling of the material to be rolled conveyed to the roughing train by moving the water ejecting nozzle of the descaling means at an angle relative to the direction of travel of the material to be rolled and then by returning the nozzle at another angle.

According to the fifth aspect of the present invention, there is provided a rolling method in a continuous hot strip rolling system in which bars are joined between a roughing train and a finishing train for continuous rolling, which comprises the steps of disposing a plurality of two-high mill stands alone as mill stands of the roughing train close to each other so as to provide tandem rolling, and conducting continuous rolling by bringing a leading end of a subsequent material to be rolled into contact with a trailing end of a preceding material to be rolled and then pushing the preceding material into the roughing train by the subsequent material.

According to the sixth aspect of the present invention, there is provided a continuous hot strip rolling system in which bars are joined between a roughing train and a finishing train for continuous rolling, wherein all mill stands in the roughing train are disposed close to each other so as to provide tandem rolling.

According to the seventh aspect of the present invention, there is provided a rolling method in a continuous hot strip rolling system in which bars are joined between a roughing train and a finishing train for continuous rolling, which comprises the steps of rolling a slab by the roughing train to produce a bar having a thickness of 60 mm or more, and joining the bars having the aforementioned thickness.

In the present invention, all the mill stands in the roughing train are constituted by the two-high mill stands. Unlike the four-high mill stand in which the work rolls are supported by the reinforcing rolls in contact therewith on a line, the work rolls in the two-high mill stand directly receive the rolling load through the bearing boxes, and the aforementioned horizontal movement of the work rolls due to the difference between the upper and lower torques thus does not occur readily. Consequently, generation of camber on the bars rolled by the two-high mill stand is lessened.

In the present invention, a rolling method is applied in which slabs having a thickness from 200 to 240 mm are rolled by the roughing train to obtain bars having a thickness of 60 mm or more, preferably, about 80 mm, and the bars having such a thickness are joined to each other. It has been generally noticed that joining of the bars becomes difficult as the thickness of the bars to be joined increases. The present inventors conducted experiments and found that when the end surfaces of 80 mm thick bars are gas melted slantingly in the direction of the thickness of the bar and are pressed against each other, 30 to 40% joining in the direction of the thickness is enough for the subsequent rolling. Therefore, the present inventors took note of the fact that temperature reduction of the bars in the present invention is less and came to the conclusion that the joining operation can thus be completed within 20 seconds. Cutting of the bars to be joined, having a thickness of 80 mm or more, is possible even during travelling of the bars. Furthermore, although it is difficult to obtain thin bars by rolling slabs by the two-high mill stands due to large rolling loads required, it is not difficult to roll slabs having a thickness of 200 to 240 mm to a thickness of about 60 mm by the two-high mill stands. Such a rolling requires about four two-high mill stands.

In the present invention, since all the two-high mill stands for producing a thick bar of 60 mm or more are disposed close to each other so as to provide tandem rolling in which the two adjacent mills perform simultaneous rolling, the line length of the roughing train is reduced as compared with the conventional roughing train in which a material to be rolled is rolled into a thin bar of about 30 to 40 mm while being prevented from being subjected to simultaneous rolling by the adjoining mill stands. Particularly, when the two-high mill stands are constituted by two twin-roll arranged stands, they can be disposed closest to each other, thus greatly reducing the line length. Reduction in the line length of the roughing train reduces the overall length of the system, and thus provides a compact system.

In the joining continuous rolling process, control of the temperature of the material to be rolled is essential. In this invention, the thick bars having a thickness of 60 mm or more are joined to each other. Reduction of the temperature of the thick bars is slower than that of thin bars of 30 to 40 mm. Also, in the present invention, since the four two-high mill stands are disposed close to each other to reduce the line length of the roughing train, as stated above, the time in which the material to be rolled is uselessly cooled in the roughing train is reduced. Hence, reduction of the temperature of the bars, which occurs until the bars reach the joining position, is lessened, and nonuniformity of the temperature of the bar located at the joining position is thus reduced. Consequently, stable joining continuous rolling can be performed, and high quality products can be manufactured.

Reduction of the distance between the adjacent two-high mill stands to a minimum value is desired in terms of reduction of the length of the system. This is achieved by the use of twin-roll arranged stands in which two pairs of work rolls are incorporated in a common housing. The use of twin-roll arranged stands is advantageous in that the installation cost can be greatly reduced as compared with provision of two separate mill stands, because the two roll exchangers can be combined. Furthermore, when an intermediate post is provided in each of the window portions of the housing assembly, the cross-sectional areas of the main posts and beams of the housing assembly can be reduced, thus further reducing the installation cost.

In the present invention, the roughing train is constituted by the two twin-roll arranged stands which include four two-high mills. The most adequate number of two-high mill stands to roll slabs of 200 to 240 mm to a thickness of about 80 mm is four.

In the joining continuous rolling conducted in the present invention, since the roughly rolled bars have a thickness of 60 mm or more, preferably, about 80 mm, the rolling rate at the entrance of the roughing train is very low. When 2 mm thick products are manufactured at a rate of 1200 m/min, slabs having a thickness, for example, 220 mm are supplied to the roughing train at a low rate of 11 m/min, and the speed at which the material to be rolled is moved in the twin-roll arranged stand is also low. In the twin-roll arranged stand, since the two pairs of work rolls are disposed close to each other, it is difficult to provide space where the descaling device is provided. Hence, scale may be generated on the surface of the material rolled by the upstream work rolls in the twin-roll arranged stand by the time it reaches the downstream work rolls. Therefore, generation of scale is prevented by providing means for covering the material to be rolled between the two pairs of work rolls with an inactive or reducing gas.

Since slabs are supplied to the roughing train at a low rate of 11 m/min, as stated above, if a conventional descaling device suitably used with a slab supply rate of 60 to 200 m/min is employed, the slabs may be cooled excessively, wasting power of the motor for the descaling pump. Hence, conventional descaling conducted using a number of fixed nozzles for ejecting liquid is replaced in the present invention by descaling suitable to the line speed of the material to be rolled and conducted by moving one or two nozzles in a direction transverse to the direction of travel of the material to be rolled. In the descaling conducted in this invention, the nozzle is moved at an angle relative to the direction of travel of the material to be rolled, and is moved back at another angle so as to descale the entire surface of the material or to avoid double descaling.

In the roughing train, the rolling reduction when thick bars are rolled can be increased because rolling load is small. The rolling reduction is limited by the biting capacity. Generally, the rolling reduction ΔH when the material to be rolled is bitten is given by $$\Delta H = \mu^2 R - (P/K)$$

where $\mu$ is the coefficient of friction between the material and the work rolls, R is the radius of the work roll, P is the rolling load, and K is the spring constant of the mill stand.

From the above equation, it is clear that the rolling reduction ΔH can be increased by P/K by inserting the leading end of a subsequent material to be rolled into the roll bite before the trailing end of a preceding material being rolled leaves the roll bite. Hence, if the rolling load P is 2000 tonf and the spring constant K is 500 T/mm, the rolling reduction can be increased by 2000/500=4 (mm). In the roughing mill No. 1 stand, the allowable rolling reduction after the material to be rolled is bitten is $\Delta H = 4\mu^2 R$, which is four times that obtained by the abovedescribed equation and which is large enough to push the material being rolled into the roughing mill No. 2 stand. Hence, in the roughing mill No. 2 stand, when the leading end of the subsequent material to be rolled is brought into contact with the trailing end of the preceding material, the rolling reduction can be further increased due to the pushing force exerted by the roughing mill No. 1 stand.

In the hot strip rolling process, slabs to be rolled are generally manufactured by the continuous casting process. The slabs manufactured by the continuous casting process have a drawback in that it is difficult to change the width of the slab. In this invention, since the width adjusting means is provided at the entrance of the roughing train, adjustment of the width of the slab can be conducted effectively. Particularly, when the press type width adjusting means is used, adjustment of the width of the slab can be conducted without reducing yield. Consequently, the width adjusting operation conducted by the conventional roll edger can be alleviated. As stated above, the roughing mill stand has a sufficient amount of force for pushing the bar after it bites the material being rolled. Therefore, if an edger is provided at a distance which ensures that the material to be rolled is not buckled by the pushing force of the roughing mill stand due to the reaction of the edger, driving of the roll edger is not necessary. Since the roll edger is of the vertically driven type, the driving device for the roll edger is very expensive. Hence, if the roll edger is of the non-driven type, installation cost can be greatly reduced, and maintenance of the roller edge can be improved. Also, the non-driven type roll edger allows generation of camber to be prevented.

DETAILED DESCRIPTION OF THE PREFERRED EMBODIMENTS

An embodiment of the present invention will now be described with reference to FIGS. 1 to 6.

Figure 1:
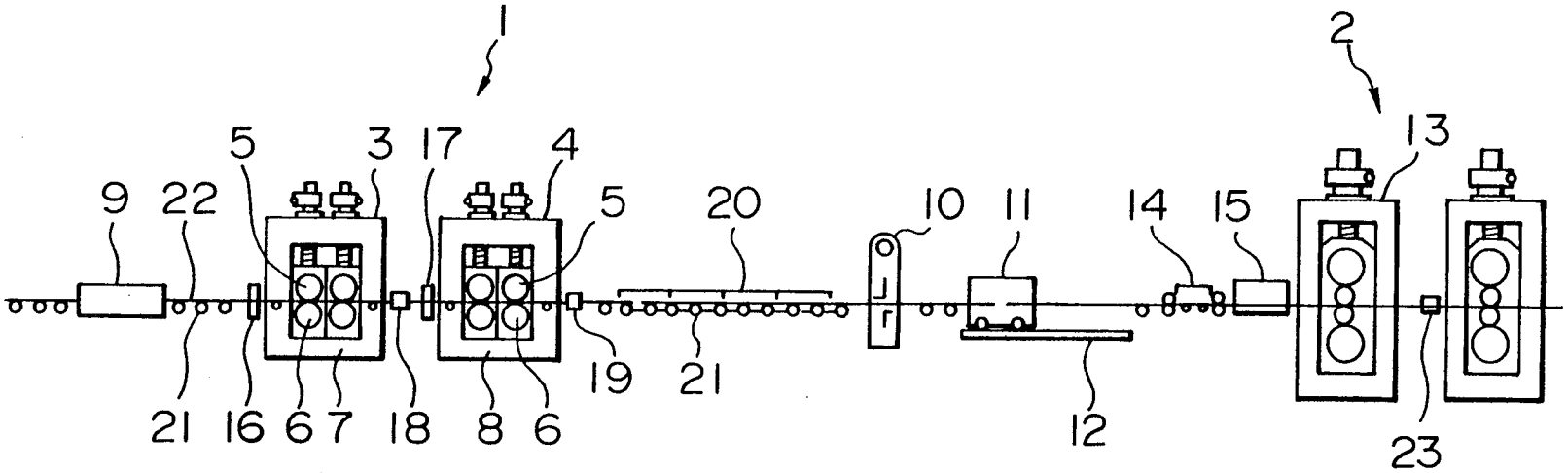
FIG. 1 shows the layout of an embodiment of a continuous hot strip rolling system according to the present invention.

In FIG. 1, a continuous hot strip rolling system includes a roughing train 1 and a finishing train 2. The roughing train 1 has two two-high twin-roll arranged stands 3, 4 of Nos. 1 and 2 disposed in series. In each of the twin-roll arranged stands 3 and 4, two pairs of work rolls 5 and 6 driven by motors of driving devices (not shown) are provided. Bearing boxes for the work rolls 5 and 6 are fitted in the window portions of each of common housing assemblies 7, 8. Each pair of work rolls 5 and 6 constitutes a two-high mill. In other words, the roughing train 1 of this embodiment includes four two-high mills which are disposed in series. In the two two-high twin-roll arranged stands 3, 4 of Nos. 1 and 2, the four two-high mills made up of the four pairs of work rolls 5 and 6 are disposed close to each other so as to provide tandem rolling in which the materials to be rolled are subjected to simultaneous rolling by the two adjoining mills.

A width press 9 for changing the width of a slab by a press is disposed upstream of the entrance of the twin-roll arranged No. 1 stand 3, and a shear 10 for cutting the leading and trailing ends of the bar being moved and a travelling joining machine 11 for joining the trailing end of the preceding bar to the leading end of the subsequent bar are disposed downstream of the twin-roll arranged No. 2 stand 4. The travelling joining machine 11 is made movable along rails 12. Downstream of the joining machine 11, a descaling device 14 for removing the scale on the surface of the bar and an edge heater 15 for heating the edge surfaces of the bar are disposed near the entrance of a No. 1 mill stand 13 of the finishing train 2. The finishing train 2 is made up of seven or eight stands not shown, including the No. 1 stand 13.

Descaling devices 16 and 17 are respectively disposed at the entrance of the twin-roll arranged stands 3 and 4. The descaling devices will be described later in detail. Non-driven roll edgers 18 and 19 are respectively disposed at the exit of the twin-roll arranged stands 3 and 4. Between the twin-roll arranged stand 4 and the shear 10 is disposed a heat insulating cover 20. Reference numeral 21 denotes a table roller; 22: a slab to be rolled; 23: a roll edger for the finishing No. 2 mill stand.

In the rolling system arranged in the manner described above, the slab 22, having a thickness from 200 to 240 mm and sent from a continuous casting system or a heating furnace, is formed to a predetermined width by the width press 9, descaled by the descaling device 16, and is sent to the twin-roll arranged No. 1 stand 3 of the roughing train 1 which rolls the slab 22 by the two pairs of working rolls 5 and 6. At that time, the leading end of the slab 22 is brought into contact with the trailing end of the preceding slab so that the preceding slab can be urged forward by the subsequent slab 22 when rolled. Thus, the rolling reduction can be increased. The slab which is made thinner by the twin-roll arranged No. 1 stand 3, i.e., the bar 22, passes through the roll edger 18 and the descaling device 17, and is sent to the twin-roll arranged No. 2 stand 4 which reduces the thickness of the bar to about 80 mm by the two pairs of work rolls 5 and 6. At this time, the leading end of the bar 22 is brought into contact with the trailing end of the preceding bar so that the preceding bar can be urged forward by the subsequent bar 22 when rolled, as in the case of the twin-roll arranged stand 3.

The bar fed out of the twin-roll arranged stand 4 passes through the heat insulating cover 20 provided to reduce the temperature reduction and hence reduce the temperature difference over the entire length of the bar, and the leading end of the bar and then the trailing end thereof are cut by the shear 10. Thereafter, the leading end of the bar is joined to the trailing end of the preceding bar by the joining machine 11 which is moved synchronously with the bar. After completion of the joining, the joining machine 11 is driven by a hydraulic cylinder or a motor not shown to be returned to its original position.

Next, the joined bars pass through the descaling device 14 provided at the entrance of the finishing train 2 to remove the scale on the surface of the bar, and then the edge heater 15 for heating the edges of the bar so as to reduce variations in the temperature, and are then fed to the finishing train 2 for finish rolling. The order in which the descaling device 14 and the edge heater 15 are disposed may be reversed.

The descaling devices 16 and 17 will be described in detail with reference to FIGS. 2 to 6.

The descaling devices 16 and 17 each have upper and lower nozzles 30 one for each. The nozzle 30 is mounted on a movable frame 31 which is movable in the direction transverse to the direction of travel of the slab 22 along a guide 32. The movable frame 31 has a rack 33 which is in mesh with a pinion 35. The movable frame 31 travels when the pinion 35 is driven by a driving motor 34 and the rack 33 is thereby moved. The guide 32 is pivotaly supported by a base 36. A cylinder 37 is coupled to the front end of the guide 32.

Figure 2:
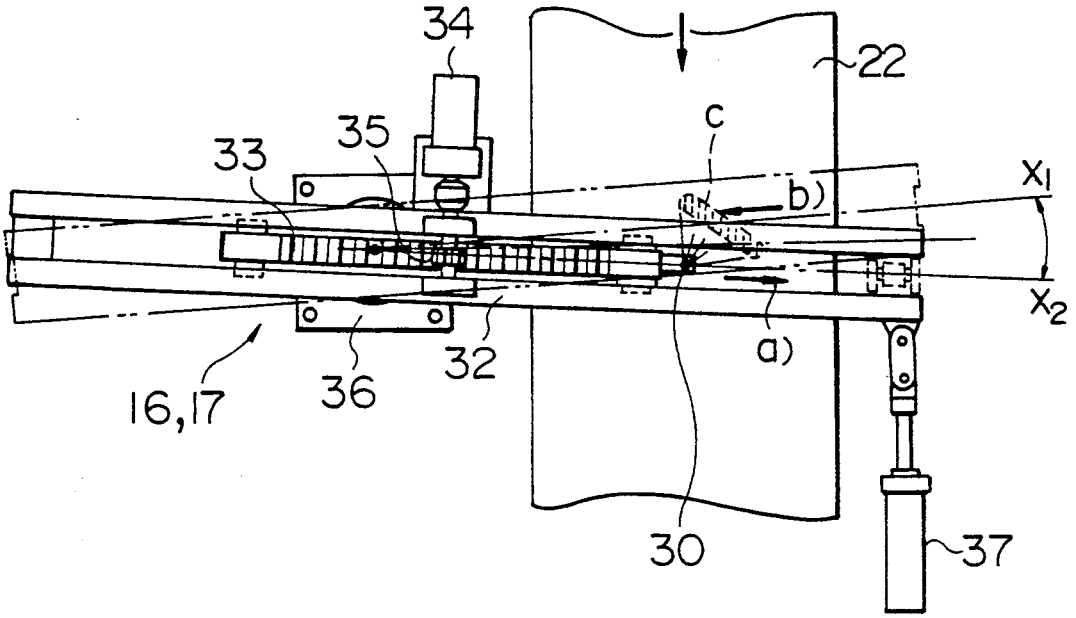
FIG. 2 is a plan view of a descaling device.
Figure 3:
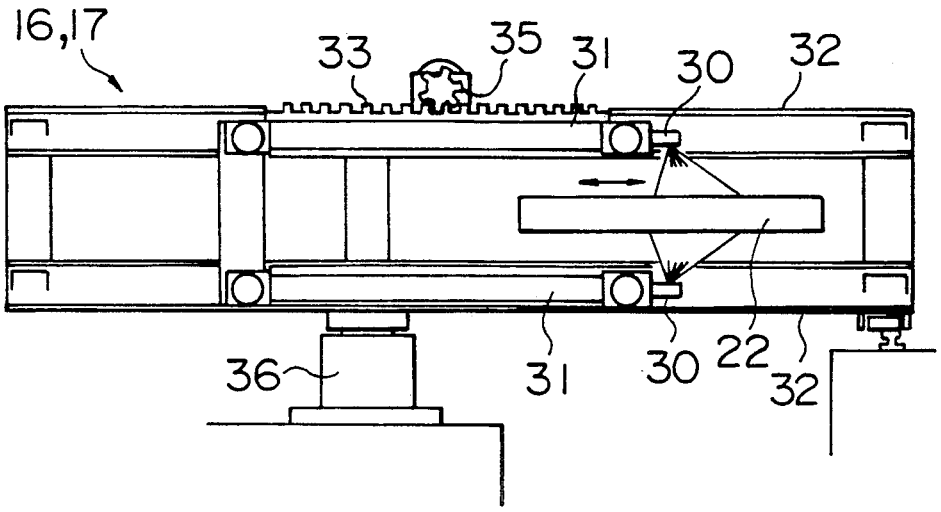
FIG. 3 is a front view of the descaling device.
Figure 4:
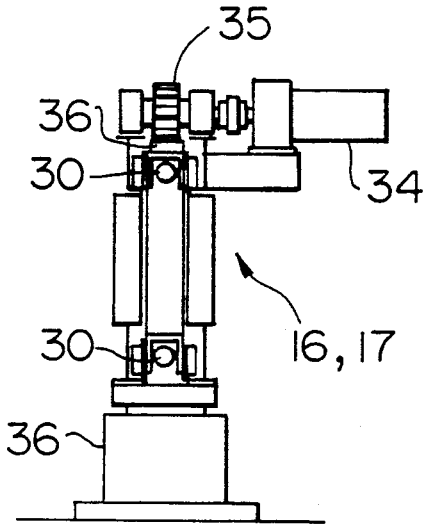
FIG. 4 is a side elevational view of the descaling device.
Figure 5:
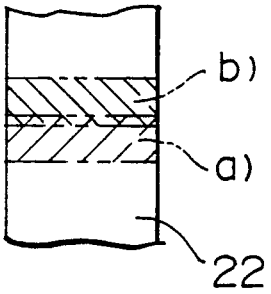
FIGS. 5 and 6 illustrate the operation of the descaling device.
Figure 6:
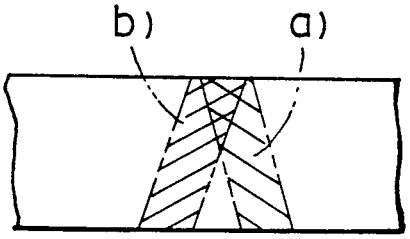

When the driving motor 34 is driven after the guide 32 is oriented in the direction indicated by (a) by the cylinder 37, the nozzle 30 proceeds in the direction indicated by (a) along the guide 32, and the water ejected from the nozzle 30 under high pressure against the slab 22 in the form indicated by C in FIG. 2 is correspondingly moved in the area indicated by (a) in FIG. 5. When the nozzle 30 reaches the opposite end portion of the slab 22, the guide 32 is pivoted about the base 36 in the direction indicated by Xl by the cylinder 37 to orient the guide 32 in the direction indicated by (b). Concurrently with this pivoting, the driving motor 34 is driven in a reverse direction to return the nozzle 30 in the direction indicated by (b). Consequently, the water ejected from the nozzle 30 under high pressure against the slab 22 is correspondingly moved in the area indicated by (b) in FIG. 5. When the nozzle 30 returns to its original position, the guide 32 is pivoted in the direction indicated by X2 by the cylinder 37 and is thereby oriented again in the direction indicated by (a). Thus, descaling can be conducted uniformly, as shown in FIG. 5, while reciprocating motion of the nozzle 30 in the lateral direction alone provides non-uniform descaling shown in FIG. 6.

The advantages of this embodiment arranged in the manner described above will be described below.

In this embodiment, the roughing train 1 having the two-high mills 5 and 6 rolls the slab to a thickness of about 80 mm. Hence, generation of camber is greatly reduced as compared with rolling by the four-high mill stands, and stable joining continuous rolling is made possible. Consequently, rolling of thin strips can be performed without problems in feeding the thin strips, and rolling at a high rolling reduction can be performed at the final stand by performing lubricating and tension rolling. These enable strips having a metallurgically excellent quality to be manufactured.

Furthermore, all the four two-high mills 5 and 6 of the roughing train 1 are disposed close to each other for tandem rolling so that the adjoining mills are subjected to simultaneous rolling, and the bar is roughly rolled to a thickness of about 80 mm. Consequently, the length of the roughing train can be reduced. Particularly, since the four two-high mills are constituted by the two twin-roll arranged stands 3 and 4, the two-high mills can be disposed closest to each other, thus greatly reducing the overall length of the roughing rolling line. As a result, the distance between the entrance of the roughing train to the finishing train can be reduced by 200 m or more, and construction cost can thus be reduced greatly.

In the joining continuous rolling, control of the temperature of the material to be rolled is essential. In this embodiment, since the slab is rolled to a thick bar of about 80 mm, as stated above, reduction in the temperature of the bar is lessened. Also, since the two-high mills 5 and 6 are disposed close to each other, the distance between the roughing train 1 and the finishing train 2 can be reduced to one twice that of the conventional rolling system or less, so that the time in which the material to be rolled is cooled uselessly in the rough rolling process can be reduced. As a result, reduction in the temperature of the bar which occurs until the bar reaches the joining position is lessened, and non-uniformity of the temperature of the bar at the joining position is thus reduced. This enables stable joining continuous rolling as well and manufacture of high-quality products.

Furthermore, since the twin-roll arranged stands 3 and 4 are used as the two-high mills, installation cost can be greatly reduced as compared with manufacture of separate mill stands, because the two roll exchangers can be combined.

Whereas the conventional roughing mill is driven by a synchronous motor, a d.c. motor or an a.c. variable speed motor must be used in this embodiment, because it performs tandem rolling. However, in the joining continuous rolling, since the rolling rate at the front stage of the roughing train 1 is about one fifth of that of the conventional system, the output of the motor can be reduced in proportion to the rolling rate. Also, low speed rolling reduces the rate of strain of the material to be rolled, and thus reduces deformation resistance to about 20%. Consequently, the amount of power for the system can be greatly reduced, and the power consumption can be reduced.

Furthermore, since the rolling rate at the entrance of the roughing train 1 is very low, the use of the conventional descaling device may cause excessive cooling of the slab. However, in this embodiment, since descaling suitable to the moving speed of the slab 22 can be conducted by moving the nozzle 30 for each of the two surfaces of the slab in the direction transverse to the direction of travel of the slab 22, descaling without excessive cooling can be performed. Also, power of the motor for the descaling pump can be saved.

In the rough rolling process, the leading end of the subsequent material to be rolled is brought into contact with the trailing end of the preceding material to be rolled so that the preceding material can be pushed forward by the subsequent material when rolled. Thus, since the leading end of the subsequent material is inserted into the roll bite of the work rolls 5 and 6 before the trailing end of the preceding material leaves it, the rolling draft can be increased. Furthermore, since the twin-roll arranged No. 1 stand 3 produces a sufficient amount of pushing force for pushing the material to be rolled into the twin-roll arranged No. 2 stand 4, the reduction draft at the twin-roll arranged No. 2 stand 4 can further be increased due to the pushing force exerted by the twin-roll arranged No. 1 stand 3.

In the hot strip rolling, slabs are generally manufactured by the continuous casting. The slabs manufactured by the continuous casting have a drawback in that it is difficult to change the width thereof. However, in this embodiment, since the width press 9 is provided near the entrance of the roughing train 1, even when the slabs fed from the continuous casting system are rolled, the width of the slabs can be adjusted without reducing the yield. Since the slab width can be adjusted by the width press 9, the operation of the roll edgers 18 and 19 can be alleviated. Also, since the twin-roll arranged stands 3 and 4 produce a sufficient amount of force for pushing the bar forward, driving of the roll edgers 18 and 19 is not necessary. This particularly applies to the roll edger 18 between the stands 3 and 4. Since the roll edger is of the vertically driven type, it requires an expensive driving device. Therefore, in this embodiment, since it is not necessary to drive the roll edgers 18 and 19, the system operation cost can be greatly reduced and the maintenance thereof can be improved. Use of the roll edgers of the nondriven type also makes it possible to prevent generation of camber. It is, however, to be noted that the downstream roll edger 19 may be driven in order to conduct fine adjustment of the slab width without generating buckling.

Figure 7:
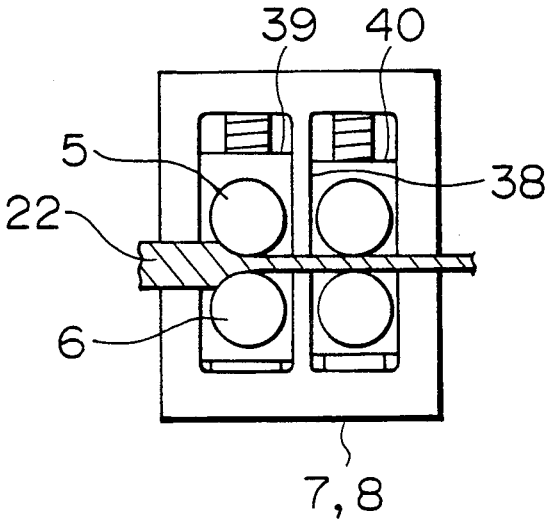
FIG. 7 is a front view of a modification of a twin-roll arranged stand employed in the present invention;.

FIG. 7 shows a modification of the twin-roll arranged stand used in this embodiment. In the twin-roll arranged stands 3 and 4 of the roughing train 1 shown in FIG. 1, the bearing boxes for supporting the upstream work rolls 5 and 6 is supported by the housing assembly 7 or 8 in such a manner as to be slidable in the vertical direction relative to the bearing boxes for supporting the adjacent downstream work rolls. However, this structure increases the width of the window portion, and therefore, to assure the mill rigidity, the cross-sectional areas of the posts and those of the beams of the housing assembly 7 or 8 must be increased. In this modification, an intermediate post 38 is provided between the two pairs of work rolls 5 and 6 in each of the window portions of the housing assembly 7 or 8, as shown in FIG. 7. Consequently, the cross-sectional areas of the posts and those of the beams of the housing assembly can be reduced, and installation cost can thus be reduced.

Figure 8:
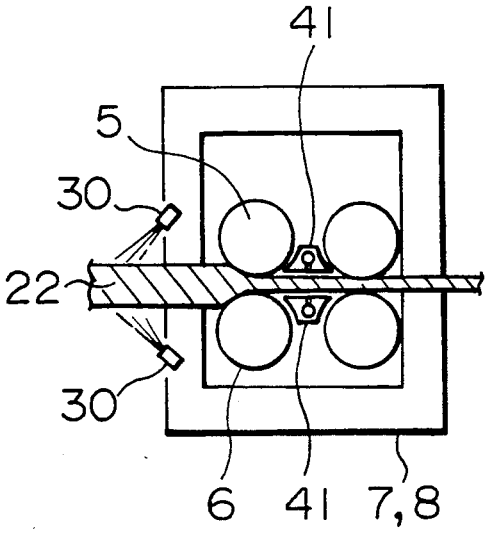
FIG. 8 is a front view of another modification of the twin-roll arranged stand used in the present invention.
Figure 9:
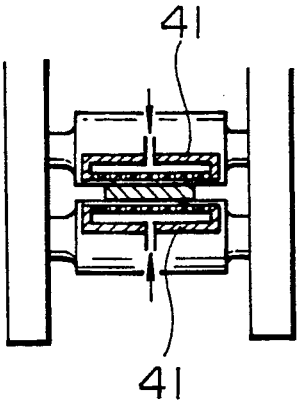
FIG. 9 is a sectional view of the stand of FIG. 8.

FIGS. 8 and 9 show another modification of the twin-roll arranged stand used in the present invention. In the joining continuous rolling conducted in this invention, since the bar is roughly rolled to a thickness of 60 mm or above, preferably, to a thickness of about 80 mm, the rolling rate at the entrance of the roughing train 1 is very low. When 2 mm thick products are manufactured at a rate of, for example, 1200 m/min, the rate at which the slabs having a thickness of, for example, 220 mm are supplied to the roughing train is 11 m/min. Accordingly, the speed at which the material to be rolled is moved in the twin-roll arranged stand is low. Hence, when the readily oxidized common steels are rolled by the upstream work rolls in the twin-roll arranged stand, unlike the stainless steels which are not readily oxidized, scale may be generated on the surface of the material to be rolled by the time the material reaches the downstream work rolls. Since the two pairs of work rolls are disposed close to each other in the twin-roll arranged stand, it is difficult to assure space where the descaling device is provided.

Accordingly, in this modification, descaling devices 30 are provided at the entrance of each of the twin-roll arranged stands 7 and 8, and inactive gas ejecting devices 41 for ejecting an inactive gas, such as nitrogen, to cover the material to be rolled 22 are disposed between the upstream and downstream work rolls 5 and 6 in each of the twin-roll arranged stands 7 and 8. Consequently, scale can be removed by the descaling devices 30 at the entrance of the twin-roll arranged stand 7 or 8, and generation of the oxidation scale can be prevented by the inactive gas ejecting devices 41 between the upstream and downstream work rolls in the twin-roll arranged stand 7 or 8. Adjacent provision of the work rolls is also enabled.

This modification is advantageous to prevent generation of oxidation scale on the surface of a common steel. When steels, such as a stainless steel, are rolled, provision of the inactive gas ejecting devices 41 can be eliminated.

As will be understood from the foregoing description, the present invention has the following advantages.

(1) Since the two-high mill stands are used in the roughing train, stable joining continuous rolling can be performed. Consequently, rolling of thin strips can be performed without problems in feeding the thin strips to be rolled, and rolling at a high rolling reduction can be performed at the final stand by performing lubricating and tension rolling. These enable strips having a metallurgically excellent quality to be manufactured.

(2) Since the work rolls in the roughing train are disposed close to each other, the distance between the entrance of the roughing train and the finishing train can be reduced by 200 m or more, and construction cost can thus be reduced greatly. This advantage can be further enhanced if twin-roll arranged stands are used in the roughing train.

(3) Since the rolling rate at the front stage of the roughing train is one fifth of that of the conventional system, the output of the motor can be reduced in proportion to the rolling rate. The low speed rolling also reduces the rate of strain of the material to be rolled, and thus reduces deformation resistance to about 20%. Consequently, the amount of power for the system can be greatly reduced, and the power consumption can be reduced.

(4) The distance between the roughing train and the finishing train is reduced to one twice of that of the conventional system, and the joined bars are rolled thick. Consequently, non-uniformity of the bar temperature can be alleviated, and high-quality products can thus be manufactured stably.

(5) Since the nozzle of the descaling device is moved in the direction transverse to the direction of travel of the material to be rolled upon descaling, the material to be rolled is not cooled excessively during descaling, and installation cost of the descaling device can be reduced.

(6) Since the preceding material to be rolled is pushed forward by the subsequent material to be rolled, the rolling draft can be increased, and the use of the non-driven type roll edger is enabled. Consequently, installation cost can be greatly reduced, and maintenance of the system can be improved.

(7) Since the twin-roll arranged stands are used in the roughing train, installation cost can be greatly reduced as compared with the provision of two separate mill stands. Also, since the intermediate post is provided at each of the window portions of the housing assembly, the cross-sectional areas of the main posts or beams can be reduced, and installation cost can thus be reduced further.

(8) Since the material to be rolled is covered with an inactive or reducing gas between the two pairs of work rolls in the twin-roll arranged stand, generation of the scale on the surface of the material to be rolled can be prevented within the twin-roll arranged stand.

What is claimed is:

1. A continuous hot strip rolling system, comprising:

a roughing train with a plurality of two-mill stands disposed close to each other wherein said two-high mill stands include at least one twin-roll stand having two pairs of work rolls which are incorporated in a common housing assembly having a window portion at each of two sides thereof so as to provide tandem rolling, a bearing box for each of the work rolls being incorporated in a window portion provided at each side of said housing;

a finishing train; and means for joining bars, arranged between said roughing two-high mill stands and said finishing train whereby bars rolled by said roughing two-mill stands are joined for continuous rolling by said finishing train.

2. A continuous hot strip rolling system according to claim 1, wherein said roughing train includes the two twin-roll arranged stands which are disposed in series.

3. A continuous hot strip rolling system according to claim 1, wherein said housing assembly of said twin-roll arranged stand has an intermediate port between the two pairs of work rolls in each of said window portions.

4. A continuous hot strip rolling system according to claim 1, further comprising water-ejecting descaling means disposed at an entrance of said two-roll arranged stand, and means for covering a material to be rolled with an inactive or reducing gas between said two pairs of work rolls in said twin-roll arranged stand.

5. A continuous hot strip rolling system according to claim 1, further comprising slab width adjusting means disposed at an entrance of said roughing train for adjusting a width of a slab being conveyed to said roughing train.

6. A continuous hot strip rolling system according to claim 1, wherein said slab width adjusting means is of a press type.

7. A continuous hot strip rolling system according to claim 1, further comprising at least one non-driven type roll edger disposed in relation to said two-high mill stand.

8. A continuous hot strip rolling system according to claim 1, further comprising at least one non-driven type roll edger disposed at an exit side of one of said two-high mill stands.

9. A rolling method in a continuous hot strip rolling system in which bars are joined between a roughing train and a finishing train for continuous rolling, said method comprising the steps:

disposing a plurality of two-high mill stands alone as mill stands of said roughing train close to each other so as to provide tandem rolling;

disposing descaling means having a water ejecting nozzle movable in a direction transverse to the direction of travel of a material to be rolled at an entrance of said roughing train; and conducting descaling of the material to be rolled conveyed to said roughing train by moving the water ejecting nozzle of said descaling means at an angle relative to the direction of travel of the material to be rolled and then by returning said nozzle at another angle.

10. A rolling method in a continuous hot strip rolling system in which bars are joined between a roughing train and a finishing train for continuous rolling, said method comprising the steps of:

disposing a plurality of two-high mill stands alone as mill stands of said roughing train close to each other so as to allow tandem rolling to be provided; and conducting continuous rolling by brining a leading end of a subsequent material to be rolled into contact with a trailing end of a preceding material to be rolled and then by pushing the preceding material by the subsequent material.

11. A continuous hot strip rolling system, comprising:

a roughing train with a plurality of two-mill stands disposed close to each other so as to provide tandem rolling;

a finishing train for continuous rolling; and descaling means disposed at an entrance of said roughing train, said descaling means having a nozzle which is movable in a direction transverse to the direction of travel of material to be rolled at a variable angle.

12. A continuous hot strip rolling system, comprising:

a roughing train with a plurality of two-mill stands disposed close to each other wherein said two-high mill stands include two twin-roll stands having two pairs of work rolls which are incorporated in a common housing assembly having a window portion at each of the two sides thereof so as to provide tandem rolling, a bearing box for each of the work rolls being incorporated in a window portion provided at each side of said housing;

a finishing train;

means for joining bars, arranged between said roughing two-high mill stands and said finishing train whereby bars rolled by said roughing two-mill stands are joined for continuous rolling by said finishing train; and roll edgers, each of which is disposed at an exit of each of said two twin-roll arranged stands, at least the upstream roller edger being of the non-driven type.

* * * * *